US006315053B1

(12) United States Patent
Coronado

(10) Patent No.: US 6,315,053 B1
(45) Date of Patent: Nov. 13, 2001

(54) METHOD OF USE AND APPARATUS FOR A HYDRAULIC TENSIONING DEVICE FOR INFLATABLE PACKER ELEMENT

(75) Inventor: Martin P. Coronado, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/398,167

(22) Filed: Sep. 17, 1999

(51) Int. Cl.[7] ..... E21B 23/06; E21B 33/127; E21B 33/129

(52) U.S. Cl. ..... 166/387; 166/187; 166/386; 175/237

(58) Field of Search ..... 166/386, 387, 166/318, 187, 99; 175/230, 237

(56) References Cited

U.S. PATENT DOCUMENTS 3,746,097 * 7/1973 Mott ..... 166/315
4,059,155 * 11/1977 Greer ..... 166/301
4,512,398 * 4/1985 Hazel ..... 166/70
5,109,926 5/1992 Mody et al. .
5,314,015 * 5/1994 Streich et al. ..... 166/184
5,396,954 * 3/1995 Brooks ..... 166/187
5,782,306 * 7/1998 Serafin ..... 166/387

FOREIGN PATENT DOCUMENTS 0 275 612 A1 1/1987 (EP) .
2051180 1/1980 (GB) .
2097451 4/1982 (GB) .

* cited by examiner

*Primary Examiner*—David Bagnell
*Assistant Examiner*—Jennifer H Gay
(74) *Attorney, Agent, or Firm*—Steve Rosenblatt, Esq.

(57) ABSTRACT

A hydraulic technique for applications with inflatable packers keeps the inflatable packer in a stretched-out condition despite the forces imposed on the packer by circulating fluids. This prevents the inflatable packer from swabbing due to the force of circulating fluids.

15 Claims, 5 Drawing Sheets

METHOD OF USE AND APPARATUS FOR A HYDRAULIC TENSIONING DEVICE FOR INFLATABLE PACKER ELEMENT

FIELD OF THE INVENTION

The field of this invention relates to inflatable packers for downhole use and, more particularly, packers which must remain in service after deflation and devices to keep them from bunching up or swabbing due to exposure to circulating fluids.

BACKGROUND OF THE INVENTION

Rig time is a significant cost item in a drilling program. Thus, techniques that can be used to reduce trips into and out of the hole, particularly during the drilling process but throughout drilling completion or workover are always desirable. One such trip-saving technique involves the use of a drillpipe mounted packer. This packer can be used when the entire casing string is assembled to test the pressure integrity below the packer. Use of this technique allows isolation of areas of the wellbore containing shallow abnormally pressurized sand. Thus, in situations where testing of each casing shoe to ensure pressure integrity is required, a packer is run as part of the drilling bottomhole assembly.

Prior techniques required the removal of the drillbit and the insertion of a blanking device for the mudline well template to be picked up on the drillpipe and run down to the sea floor. A remotely operated vehicle (ROV) equipped with a camera was used to establish the position of the drillpipe relative to the well slot in the template. Once that position was established, a submersible drilling vessel was moved to position the drillpipe above the proper slot in the template and the drillpipe was lowered to engage the blanking device into the well slot. Once in position, the casing string and the shoe could be pressure tested for leak off. Once the shoe was successfully tested, the blanking device and the drillpipe were removed and pulled back to the surface. The drill bit was reinstalled and run back into position just above the well template. Again, the vessel had to be repositioned to allow the bottomhole assembly to be run into the proper well slot. Drilling ahead then proceeded at this point.

The addition of a packer on the bottomhole assembly for the drilling streamlines this procedure. However, when using this type of technique at the conclusion of the pressure test for the shoe, drilling needed to continue. This involved circulation through the drillstring, through the bit and back up the annulus. The inflatables previously used in this application on a drillstring bottomhole assembly were of the type having a sliding collar to accommodate the expansion of the inflatable element. Upon deflation, the movable collar on the inflatable was subject to forces induced by circulating fluids during the drilling operation. In addition, cuttings from drilling would also come up the annulus around this deflated packer. The forces generated by the circulating fluid during drilling and potentially further combined with mud or cuttings sticking to the inflatable element on the inflatable put substantial forces uphole on the inflatable element. This tended to push the sliding collar uphole and force the inflatable element outwardly. The forces could be so great as to make the now deflated packer act as a piston to virtually drive the drillpipe out of the wellbore. Thus what was needed was an effective technique to hold the slidable collar against the forces created due to the circulating fluid in the annulus. Due to the sometimes large sizes of such packers, i.e., in the order of 13 inches or greater, coil springs were ineffective to provide a sufficient resisting force to the hydraulically induced forces from circulation. Accordingly, the objective of the present invention is to employ hydraulic principals and pressure differentials so as to provide a hydraulic assist to the sliding collar in the now deflated packer to prevent it from swabbing uphole as fluid is circulated during drilling.

SUMMARY OF THE INVENTION

A hydraulic technique for applications with inflatable packers keeps the inflatable packer in a stretched-out condition despite the forces imposed on the packer by annular circulating fluids. This prevents the inflatable packer from swabbing due to the force of circulating fluids.

DETAILED DESCRIPTION OF THE PREFERRED EMBODIMENT

Figure 1A:
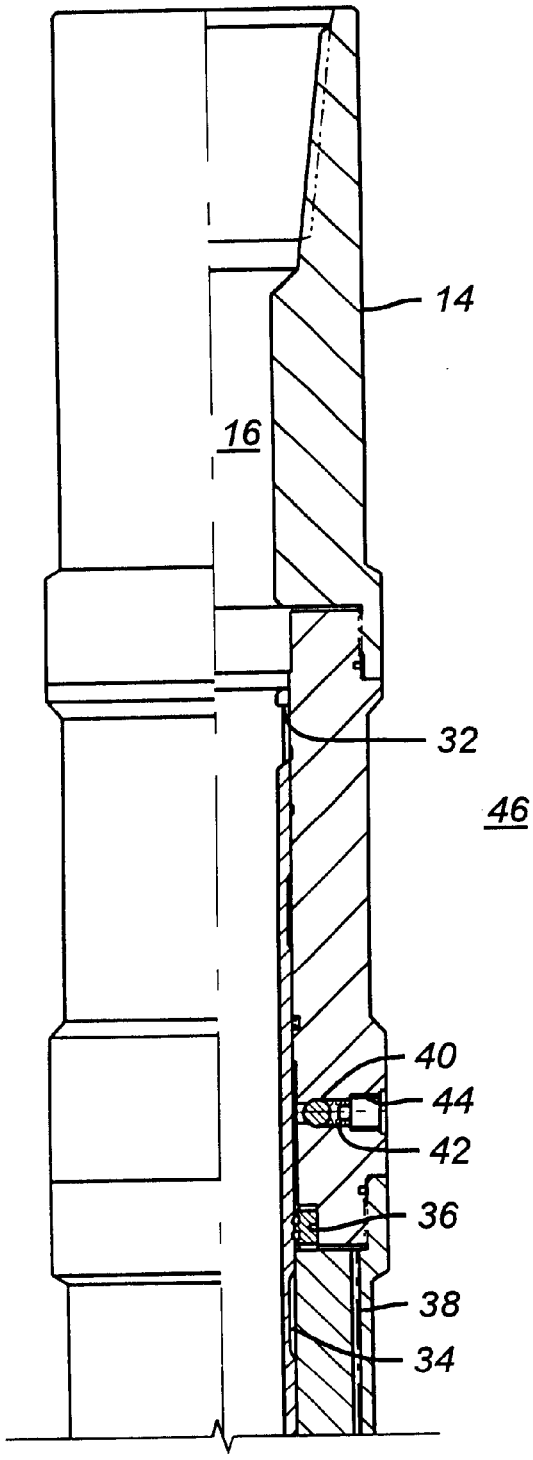
FIGS. 1*a*–1*e* are part section view of the drillstring-mounted packer of the present invention, showing the hydraulic tensioning device at its lower end.
Figure 1B:
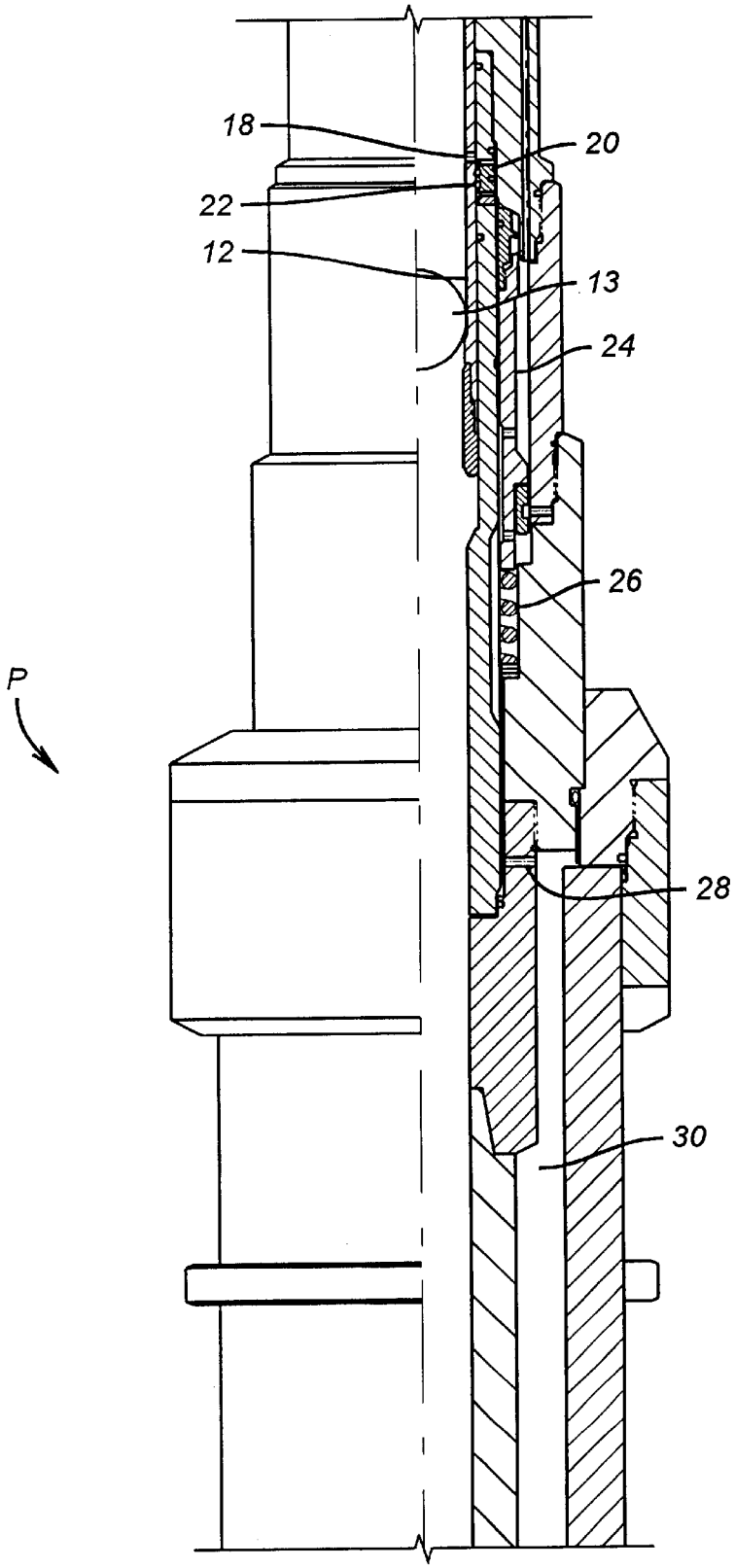

Referring to FIGS. 1*a*–1*e,* the packer P has an inflatable element 10 which is inflated at the desired depth in the well by displacement of control sleeve 12 by an assembly/object dropped 13 in through the drillstring 14 to block the passage 16 in the drillstring 14. Downward displacement of the control sleeve 12 allows port 18 to shift below insert 20 which has on it a seal or seals 22. Pressure applied through port 18 communicates poppet sub 24, which is biased by a spring 26. Upon sufficient downward displacement of poppet sub 24 compressing spring 26, applied pressure through port 18 can communicate through passage 28 to annular space 30 under the inflatable element 10. Removing pressure applied to port 18 allows spring 26 to push the poppet sub 24 back upwardly to retain the inflate pressure in the packer.

The packer P can be deflated by inserting a tool and engaging shoulder 32 to pull up the control sleeve 12. This allows groove 34 to align with seal 36 so as to create a bypass. The pressure in annular space 30 is in communication with passage 38 and can, thus, escape around seal 36 when groove 34 is aligned opposite seal 36. The pressure in annular space 30 can then escape by displacing ball 40, which is biased by spring 42, thus allowing pressure to escape through port 44 into the annular space 46 around the drillstring 14. Thus, once released, the packer P cannot have its element 10 reinflated because the annular space 30 is exposed to the same pressure as the surrounding annular space 46.

A rupture disc 47 can also be used as a backup way to deflate.

Figure 1C:
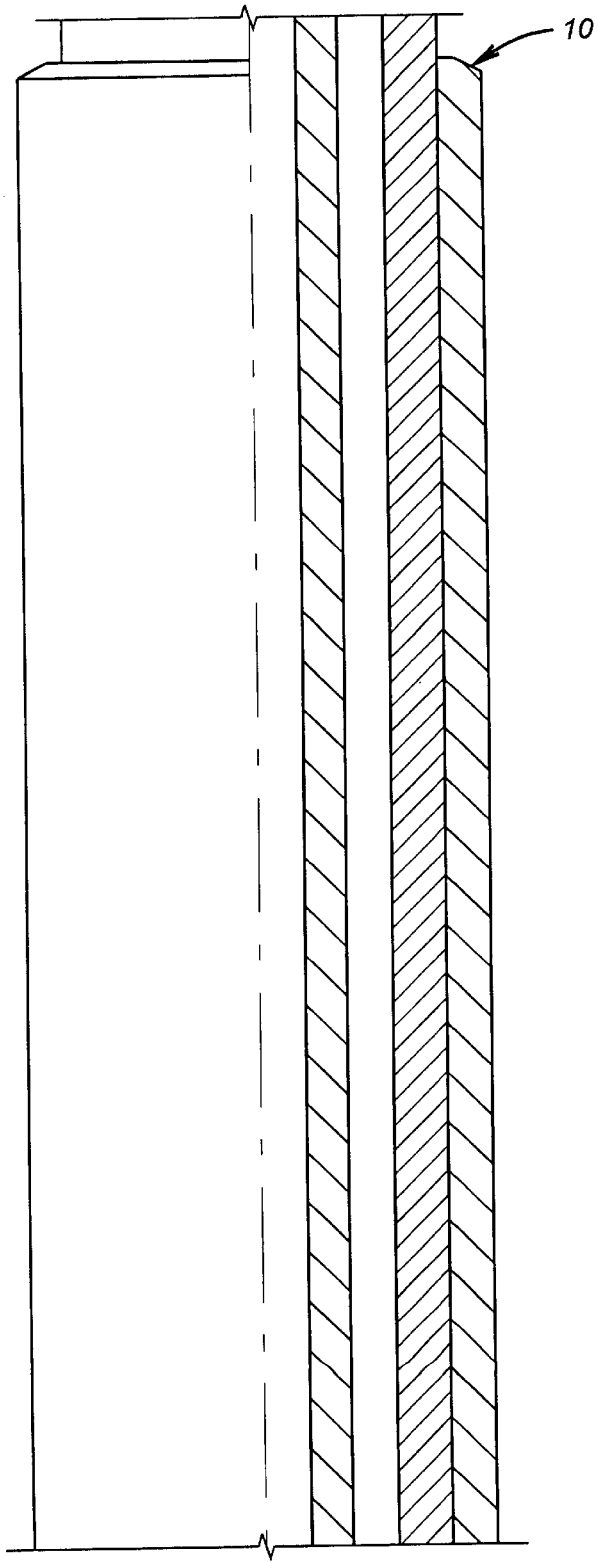
Figure 1D:
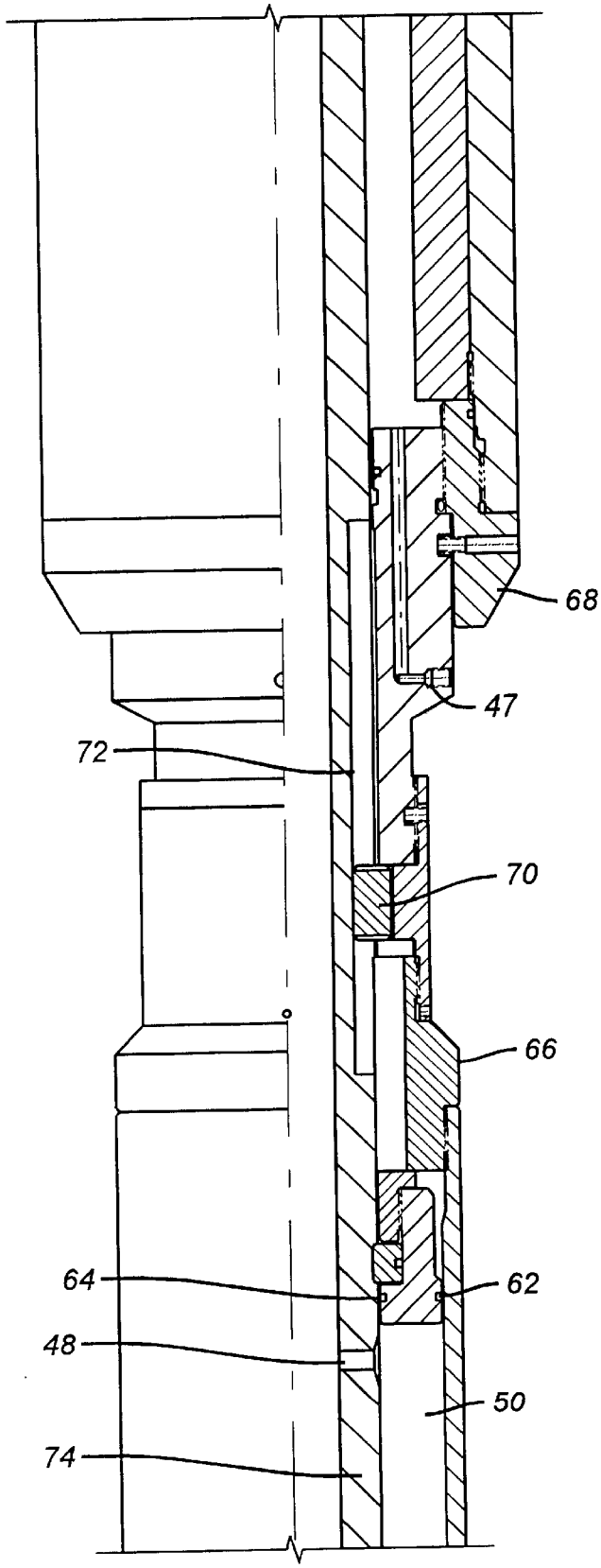
Figure 1E:
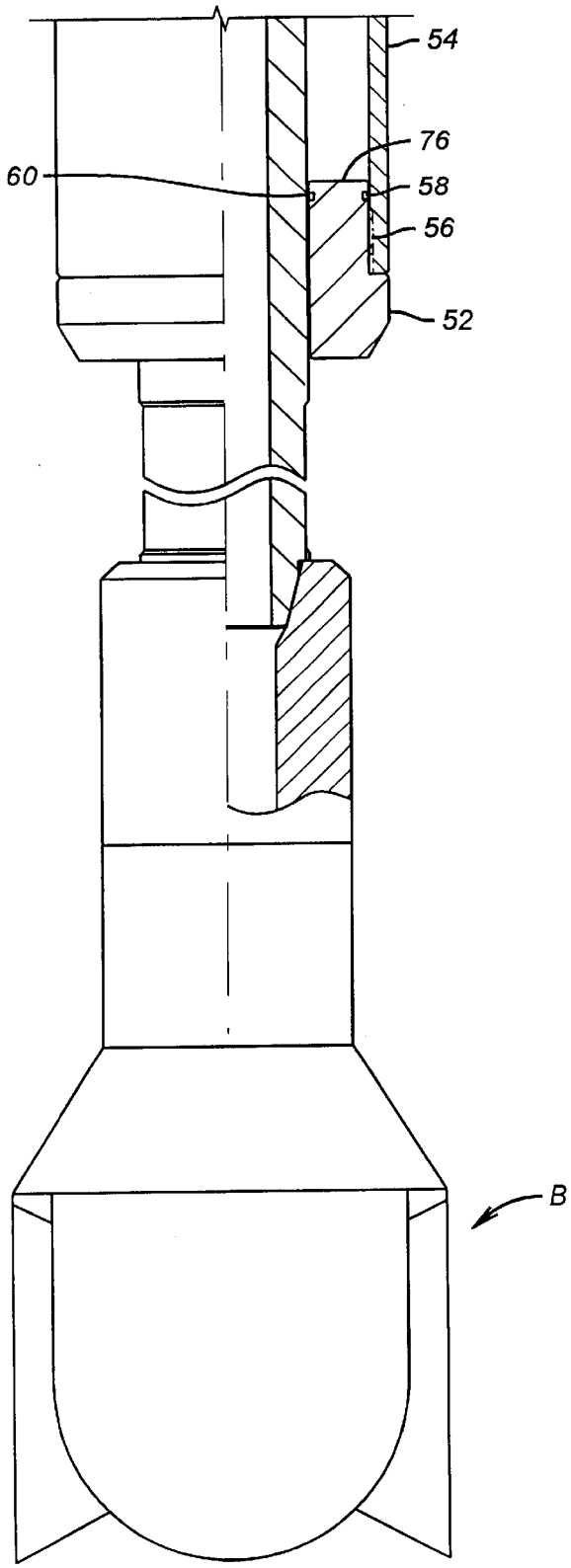

Referring to FIGS. 1*c* and 1*d*, it can also be seen that the drillstring 14 has a port 48 which allows fluid communication into a cavity 50. Cavity 50 is defined by tension housing sub 52, which is attached to tension housing 54 at thread 56. Seals 58 and 60 seal off the lower end of cavity 50. Seals 62 and 64 seal off the upper end of cavity 50. Tension housing 54 is secured to the lug retainer adapter 66. Lug retainer adapter 66 is connected to an assembly of parts which ultimately connects to the bottom adapter 68. Upon pressurization of annular space 30, the bottom adapter 68 moves upwardly, taking with it the entire assembly of parts between bottom adapter 68 and lug retainer adapter 66. A torque lug 70 rides in a groove 72 in mandrel 74.

Prior to inflation an assembly/object is dropped 13 in to seal above port 48 preventing inflation pressure for reaching chamber 50. Those skilled in the art will appreciate that thereafter upon inflation resulting from pressurizing the annular space 30, the assembly of parts from bottom adapter 68 through the tension housing sub 52 will all move uphole in tandem, thus, in effect, reducing the volume of cavity 50. As previously stated, testing can go on with the element 10 of packer P inflated, and at the conclusion of the testing, the element 10 is deflated, as previously described. Thereafter, drilling must continue, and a clear passage is presented comprising of passage 16 through control sleeve 12 down to the drillbit. In view of the pressure losses through the drillbit and through the remainder of the drillstring below the packer P, the pressure at port 48 will exceed the outside pressure in annular space 46. Accordingly, there's a greater pressure applied to surface 76 than to the outer surface of tension housing sub 52, which is exposed to the annulus pressure in annular space 46. As a result, there's a net unbalanced downward force on tension housing sub 52 from normal drilling activities. That net unbalanced force is translated through the connected parts as previously described to bottom adapter 68 to pull it down to keep the element 10 in a taut position against the uphole forces of circulating mud with cuttings that are coming uphole in the annular space 46. The components can be configured so that a substantial downward force can be exerted on the bottom adapter 68 through the port 48 onto surface 76 so as to keep the element 10 in its taut position. Testing can still occur using the inflated element 10 because there is a no-flow condition during the testing, thus there's no differential or unbalanced forces on tension housing sub 52 when the drillstring, in combination with an inflated packer P, is used to test the casing string, for example.

Those skilled in the art will appreciate that although one specific embodiment of use of pressure differentials to maintain the packing element 10 in a taut position has been illustrated, other configurations can be employed without departing from the spirit of the invention. Thus, any mechanical execution of parts which takes advantage of the higher pressure inside the drillstring 14, as compared to the annular space 46, and employs such pressure differential to exert a downward force on the element 10 to keep it from swabbing, is within the spirit of the invention.

The foregoing disclosure and description of the invention are illustrative and explanatory thereof, and various changes in the size, shape and materials, as well as in the details of the illustrated construction, may be made without departing from the spirit of the invention.

What is claimed is:

1. An apparatus for resisting swabbing of an inflatable packer mounted externally to a tubing string, comprising:

a mandrel having an internal flowpath with connections on both ends for securing to the tubing string;

the inflatable packer mounted mounted to the outside of said mandrel and actuable from said flowpath, further comprising an inflatable element and a movable collar assembly adjacent one end thereof, said movable collar assembly movable in a first direction to facilitate inflation and in an opposite second direction to facilitate deflation of said inflatable element;

a sleeve supported by said collar assembly and defining at least in part a sealed chamber outside said mandrel;

said mandrel formed having a passage to said chamber such that applied pressure from said flowpath, after said inflatable element has been deflated, creates an unbalanced force in said second direction on said sleeve connected to said movable collar to hold said inflatable element in a deflated condition thereby resisting swabbing by said element responsive to fluid movement outside said element.

2. The apparatus of claim 1, wherein:

said sleeve is in force balance when there is no flow through said flowpath.

3. The apparatus of claim 2, wherein:

said sleeve is rotationally locked to said mandrel.

4. The apparatus of claim 3, further comprising:

a sliding sleeve in said flowpath selectively covering an inflation port for said inflatable packer;

said sliding sleeve selectively obstructed by an object inserted through said flowpath.

5. The apparatus of claim 4, wherein:

said object is retrievable from said sliding sleeve after said packer is inflated.

6. The apparatus of claim 5, wherein:

said object retrievable by a wireline.

7. The apparatus of claim 4, wherein:

said packer further comprising a first check valve;

said sliding sleeve comprising a port, said sliding sleeve selectively moveable by applied pressure to said object to position said port on said sliding sleeve to allow pressure in said flowpath to reach said first check valve.

8. The apparatus of claim 7, wherein:

said sliding sleeve further comprises a groove;

said element comprises a deflation path obstructed by a deflation seal;

said groove, when spanning said deflation seal, allows said element to deflate.

9. The apparatus of claim 8, wherein:

said deflation path extends to outside said mandrel.

10. The apparatus of claim 9, further comprising:

a second check valve in said deflation path to allow one-way flow of fluid from between said mandrel and said clement to outside said mandrel.

11. The apparatus of claim 10, further comprising:

a rupture disc in fluid communication with the space between said mandrel and said element for an alternate deflation path for said element.

12. A method of keeping an inflated and then deflated inflatable element from swabbing due to flow in an annular space around it in a wellbore, due to resumption of drilling, comprising:

mounting the inflatable element on a mandrel with one end of the inflatable element selectively movable between two positions corresponding to inflation and deflation of said inflatable element:

running the mandrel into the wellbore;

selectively inflating and then deflating said element;

retaining said movable end of said, now deflated, inflatable element in said deflated position with pressure differential between a flowpath in said mandrel and said annular space, caused by fluid circulation during resumption of drilling.

13. The method of claim 12, further comprising:

mounting said mandrel as part of a drilling bottomhole assembly comprising a bit;

using fluid circulated through said bit to create said pressure differential.

14. The method of claim 13, further comprising:

providing a movable collar assembly connected to said element;

defining a sealed chamber outside said mandrel with, at least in part, said collar assembly;

providing an access port through said mandrel into said chamber;

using said pressure differential acting on said collar assembly to create a tensile force on said element.

15. The method of claim 14, further comprising:

putting the portion of said collar which defines said chamber in pressure balance when there is no flow in said mandrel.

* * * * *